US007594824B1

(12) United States Patent
Nourollahi

(10) Patent No.: US 7,594,824 B1
(45) Date of Patent: Sep. 29, 2009

(54) LOW PROFILE ANGULAR BACKSHELL ASSEMBLY DEVICE

(75) Inventor: Abbas Nourollahi, P.O. Box 270004, San Diego, CA (US) 92198

(73) Assignee: Abbas Nourollahi, San Diego, CA (US)

( * ) Notice: Subject to any disclaimer, the term of this patent is extended or adjusted under 35 U.S.C. 154(b) by 0 days.

(21) Appl. No.: 12/120,753

(22) Filed: May 15, 2008

(51) Int. Cl.
*H01R 13/64* (2006.01)

(52) U.S. Cl. ..... 439/374

(58) Field of Classification Search ..... 439/455, 439/607–610, 362, 364, 341, 374, 365, 902, 439/361, 460, 468–473, 701
See application file for complete search history.

(56) References Cited

U.S. PATENT DOCUMENTS 4,842,550 A 6/1989 Fry, Jr. et al.
5,244,407 A 9/1993 Volk
6,017,245 A 1/2000 Karir
6,561,835 B1 * 5/2003 Hirschberg et al. ..... 439/362
6,751,392 B1 * 6/2004 Szilagyi et al. ..... 385/134
7,270,562 B1 * 9/2007 Trout et al. ..... 439/364

OTHER PUBLICATIONS

All Best Connectors, VHDC1 Series, All Best Connectors Catalog 2003, p. 35 and 39, Version 1 Taiwan, R.O.C.
The Mate Company, Located on Website on Apr. 10, 2008 www.tmcscis.com SCIS Terminators→External and Diagnostic Terminators→External VHDC 1 68→68 Male→Ultra 320/Ultra 60/Offset→Part No. SKU:T225XT-LVD32005 Other Information is Unknown.
Honda Connectors, Located on Website on Apr. 10, 2008 www.hondaconnectors.com From Home→.8mm Pitch Connectors→HDRA Series→HDRA-E68LPD Other Information is Unknown.

* cited by examiner

*Primary Examiner*—Edwin A. Leon

(57) ABSTRACT

A backshell for an electrical connector gives the electrical connector protection and firmness enables it to be inserted in to an electrical device in a particular orientation.

A portion of the cable and the connector resides inside the backshell. The cable is forced into a right angle turn in the interior of the backshell. The backshell of this invention connected to the cable and housing the connector provides an assembly with minimum amount of clearance space.

3 Claims, 6 Drawing Sheets

LOW PROFILE ANGULAR BACKSHELL ASSEMBLY DEVICE

BACKGROUND

1. Field of Invention

This invention relates to a backshell for an electrical connector assembly for VHDCI (Very high density cable interconnect) series, more particularly with an angular position which cable opening of the backshell is perpendicular to the plane of chamber of the backshell to force a particular orientation of the connector cable with respect to an interface device, which provides the cable connector assembly in a minimum amount of clearance space for high speed electrical transmission systems such as military and other applications.

2. Prior Art

DESCRIPTION OF THE PRIOR ART

Structures are known for use with electrical connectors to provide some degree of strain relief and to thereby prevent against damage due to forces exerted during the frequent connection and disconnection. Some such structures are known as backshells and surround the cable and connector.

Cable connector backshell assemblies for high speed and high density transmission (VHDCI) electrical devices presently available are only suited for applications that limited spacing is not an issue. When spacing is limited and the cable needs to be bent to mate with the respected device this causes many problems. For example in military applications when an electrical enclosure has plurality of components and limited depth, a bending radius takes tremendous amount of space in some cases it makes it difficult or impossible to close the enclosure's lid. A bending radius puts stress on the interfacing connector device therefore causes imperfect connectivity and excessive ware on the connectors.

Typical backshells available in the industry such as the ALL-BEST CONNECTORS type VHDCI series manufactured by All Best Electronics Co. Ltd Taiwan, R.O.C (see page 35 of the 2003 Version 1 All-Best connectors catalog), VHDCI Off-Set U320/SE backshell by THE MATE COMPANY, Temecula, Calif. (see website: tmcscsi.com), and also HDRA-E68LGKPC by HONDA CONNECTORS, Bannockburn, Ill. (see website: hondaconnectors.com) are all straight angle backshell and are not suited where spacing is limited and there are plurality of components make it very difficult to attach the cable connector assembly with a straight angle backshell.

The following prior art for the said application is not desirable either.

For example, one such backshell is shown in U.S. Pat. No. 4,842,550 which issued to Rupert on Jun. 27, 1989. This backshell includes a pair of half shells which can be engaged around an electrical connector. This backshell consist of two shells to receive the cable in a direct straight angle. Therefore, it is considered undesirable in view of the complex plural components required and straight cable exit restricts the installation in a limited amount of clearance space. Yet, another backshell housing shown in U.S. Pat. No. 5,244,407 which issued to Volk on Sep. 14, 1993, also requires a straight cable exit, therefore, being considered undesirable in a space where there is limited clearance. Another prior art of U.S. Pat. No. 6,017,245 issued to Arvind on Jan. 25, 2000, shows a cable connector backshell assembly with a straight angle cable exit, again undesirable for the application where space is limited.

Accordingly, an object of the present invention is to provide a low-profile right angle backshell assembly to house a portion of a cable adjacent to the connector and the connector for high speed high density electrical transmission VHDCI series to mate with respected device without bending the cable, therefore, saving space, relieve stress on connectors, increase better connectivity, and longer life for the connectors.

SUMMARY OF THE INVENTION

Broadly the present invention provides a right angle backshell assembly for high speed high density VHDCI (very high density cable interconnect) electrical transmission cable connector.

BRIEF DESCRIPTION OF THE DRAWINGS

Description: The novel feature believed characteristic of the invention are set forth in the claims. The invention itself will best be understood by reference to the following detailed description of an illustrative embodiment when read in conjunction with the accompanying drawings, wherein:

DRAWING

Reference Numerals

Figure 1:
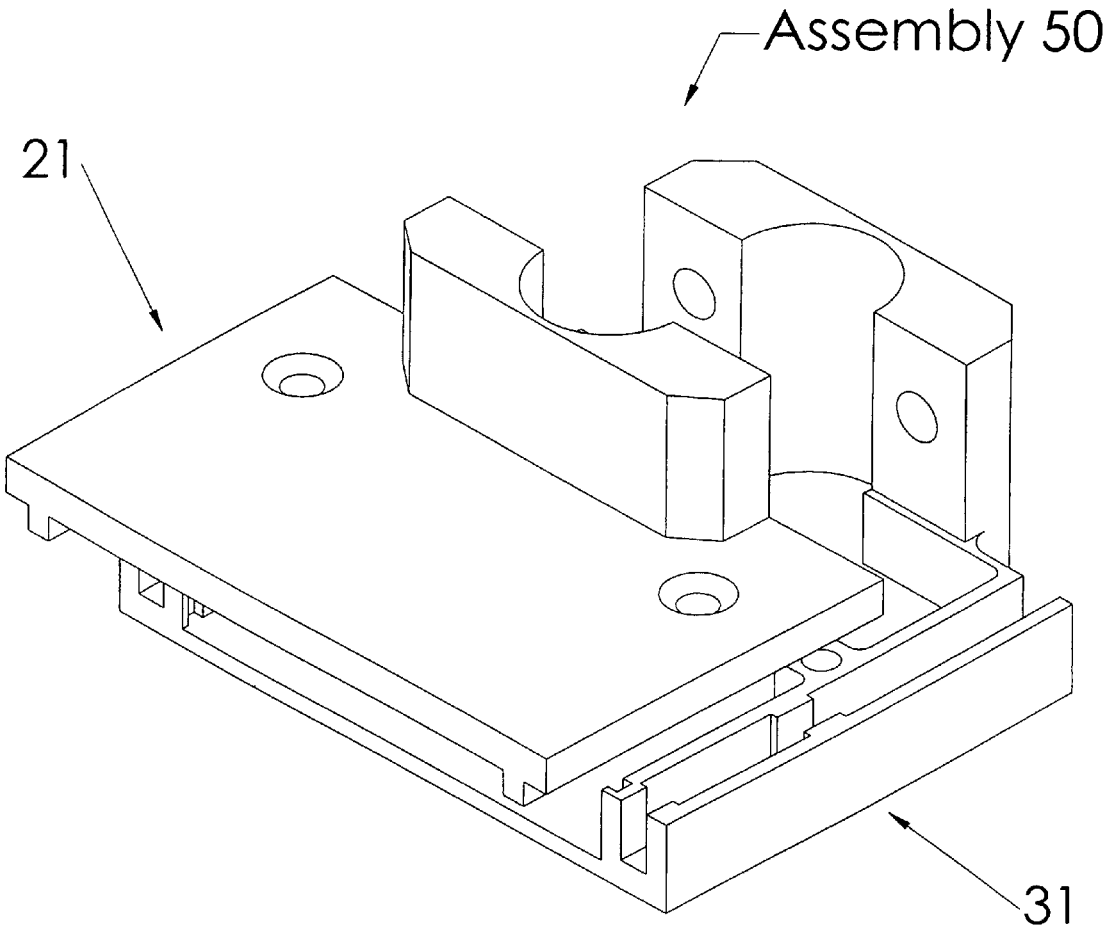
FIG. 1 is an isometric view of an open backshell in conformance with the present invention.

21 Cover
22 Chamber top
23 Cover top securing holes
24 Cover back tapped holes
25 Cover right angle cable opening
27 Rails
29 Cover corners chamfered
31 Base
33 Channels
35 Base tapped holes
37 Base right angle cable opening
38 Notches
39 Base back securing countersink thru holes
41 Chamber bottom
43 Base corners chamfers
50 Backshell assembly
51 Cover, half circle cable opening
52 Base, half circle cable opening

DETAILED DESCRIPTION OF THE INVENTION

Referring now to the figures and in particular to FIG. 1, a preferred embodiment of the invention and its use will be described.

FIG. 1 illustrates a backshell assembly 50 of base 31 and the cover 21. Half circle opening 51 in FIG. 2 and half circle opening 52 in FIG. 3 from the base 31 and the cover 21 upon closure form an opening to admit and retain an end portion of a cable. Said opening 51 and 52 is a circular opening which fits snugly around the circumference of the cable this opening has a substantially right angle turn to guide the cable in a substantially right angle. Also upon closure of the cover 21 and the base 31 a chamber is created by surfaces of 22 in FIG. 2A and from 41 in FIG. 3 to house the electrical terminal connector which is at a substantially right angle with the cable.

Figure 2:
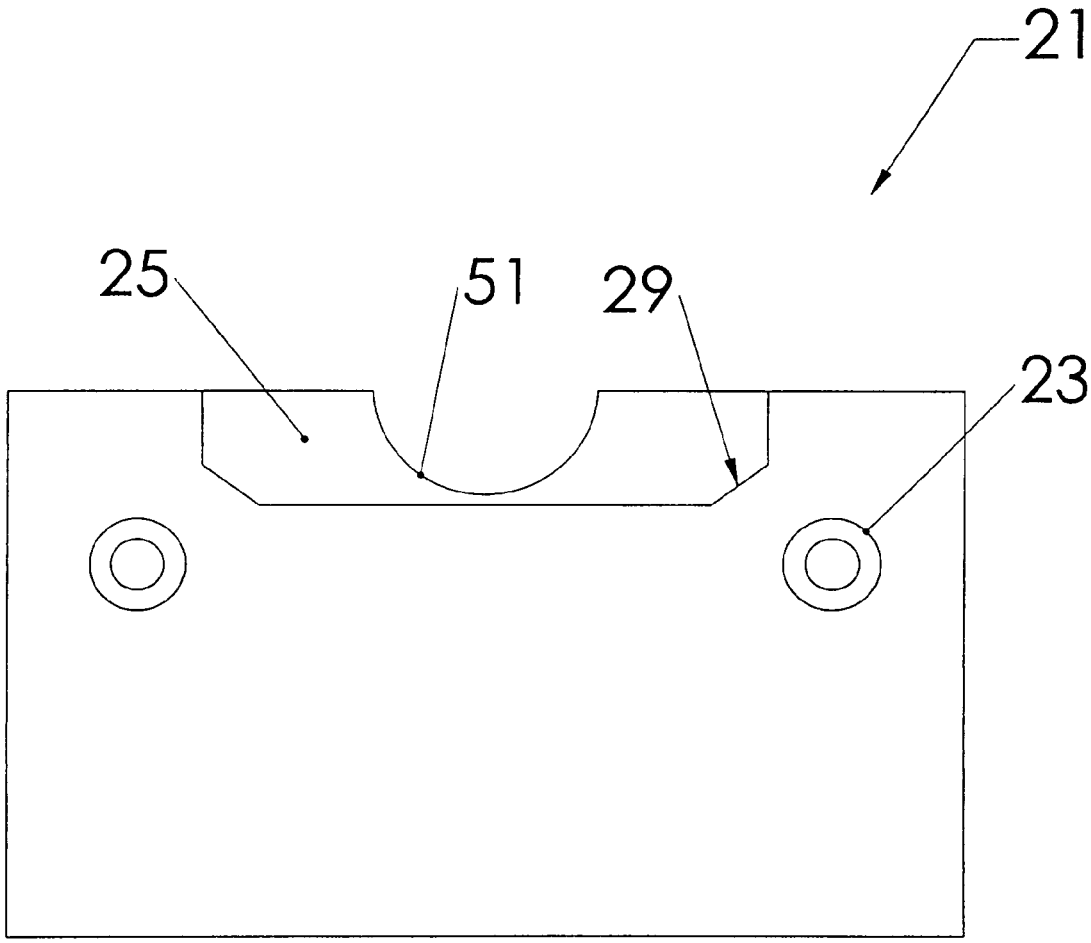
FIG. 2 is a top view of the cover in conformance with the present invention.

FIG. 2 illustrates the cover 21 of the backshell assembly 50 used to construct a backshell assembly wherein shows the positions of the left and right side counter sink and thru holes 23 securing the cover. A right angle preferred embodiment 25 located at the backend of 21 wherein a half circle 51 is formed through the embodiment 25 wherein to partially enclose the electrical cable. The right angle embodiment 25 is chamfered on both sides of its front corners 29 to create a low profile embodiment.

Figure 2A:
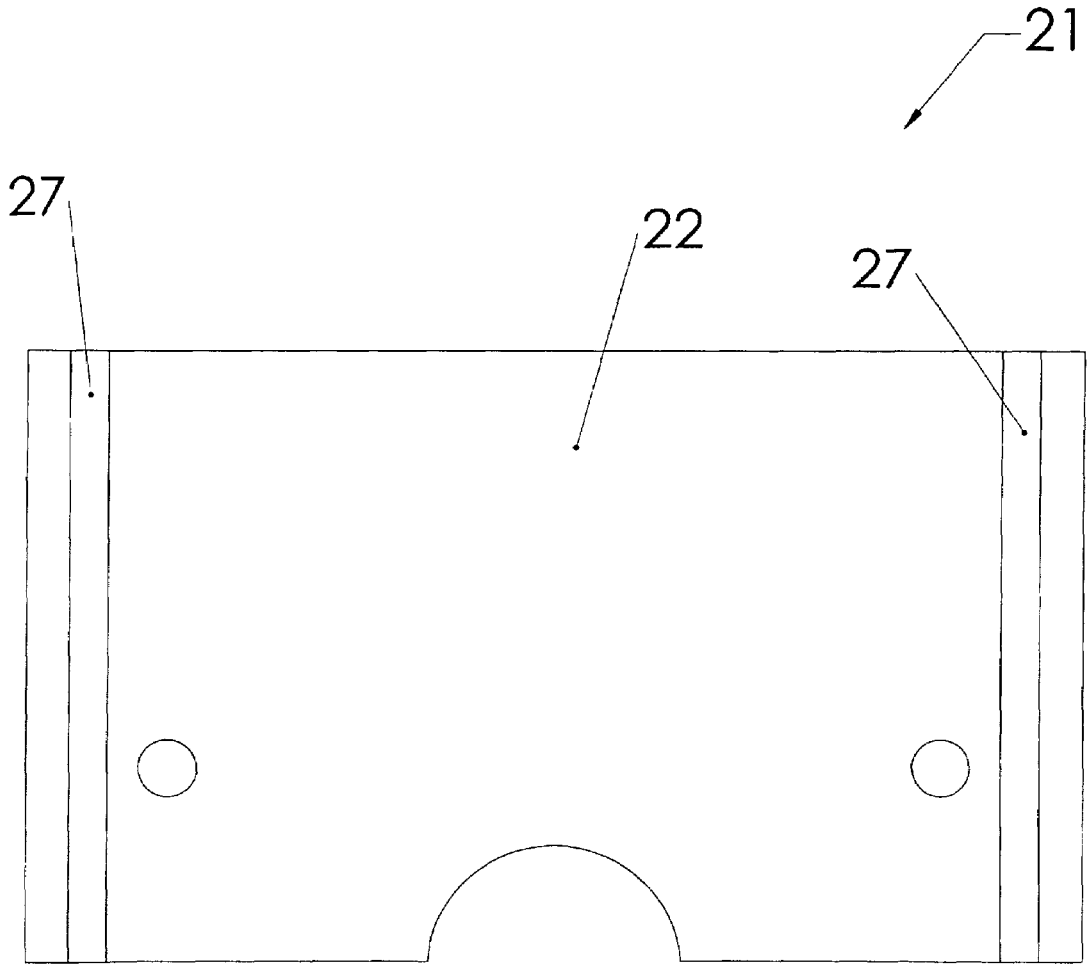
FIG. 2A is a bottom view of the cover in conformance with the present invention.
Figure 3:
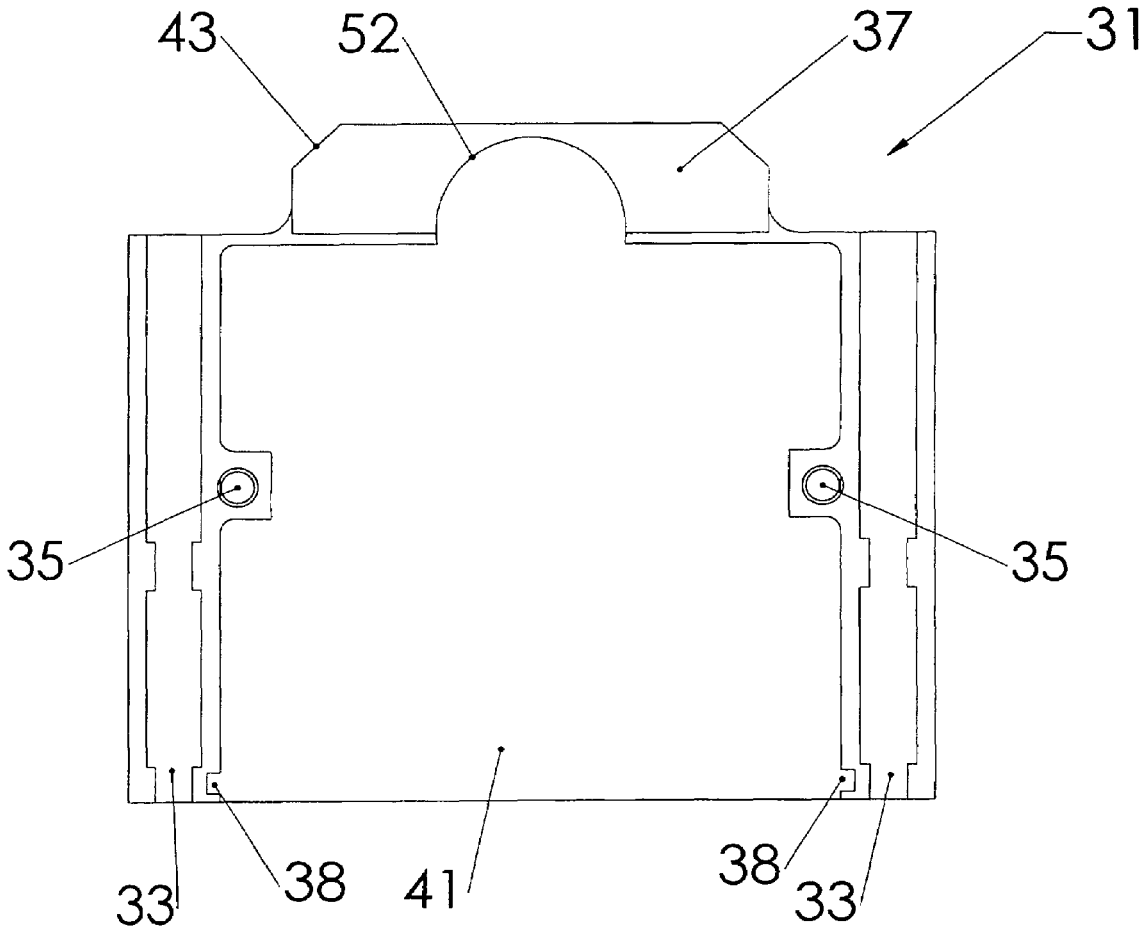
FIG. 3 is a top view of the base in conformance with the present invention.

FIG. 2A the embodiment 21 consist of left and right rails 27 extending from the back to the front of the cover wherein said rails are parallel to one another and to the side edges of the embodiment 21, wherein creates a portion of the backshell chamber 22, and intended to engage in channels 33 FIG. 3 where by enclosing the channel 33 and positioning the cover to the base 31 of the backshell assembly.

Figure 2B:
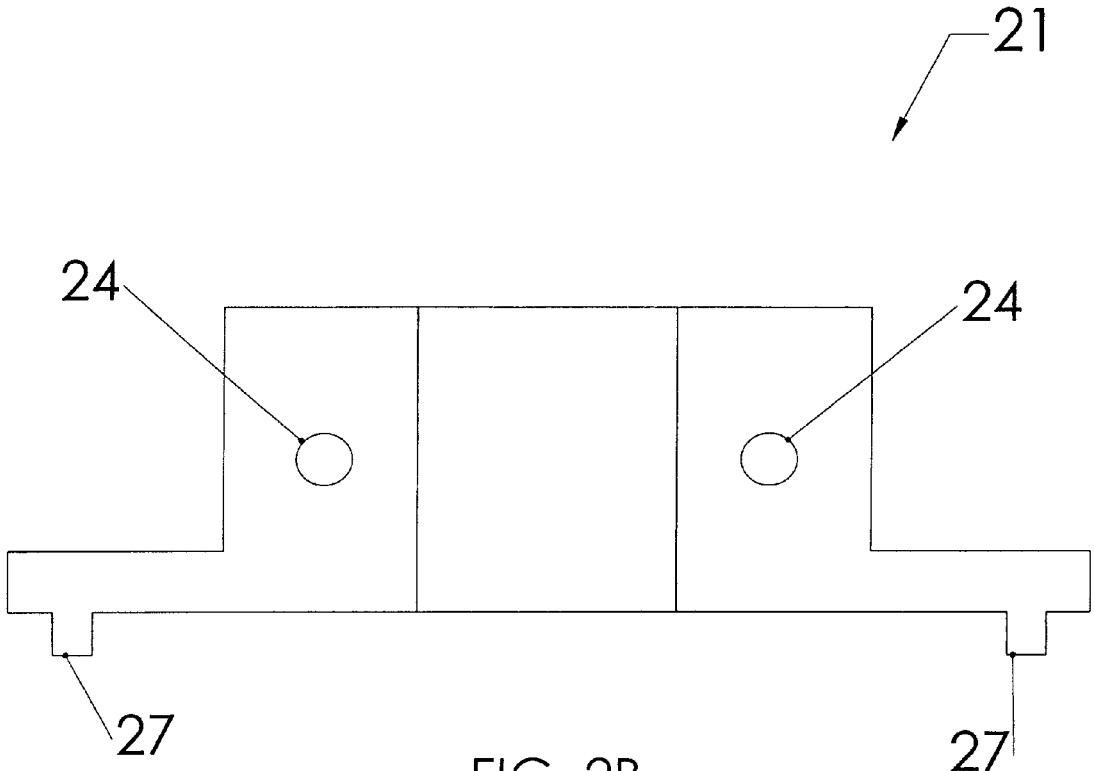
FIG. 2B is a back view of the cover in conformance with the present invention.

FIG. 2B further illustrates the positioning of the back screws used to secure the base 31 to the cover 21 from the back by means of screws to threaded holes 24.

FIG. 3 illustrates the embodiment of the base of the backshell assembly 31 used to construct a backshell assembly 50 wherein the embodiment 31 consist of left and right channels 33 parallel to one another and side edges of embodiment 31, wherein creates a portion of the backshell chamber 41, which houses the electrical connector. Channels 33 are intended to house the jackscrews (not shown) to secure backshell assembly to mating device. Channels 33 are extending from the back to the front of base 31. FIG. 3 further illustrates threaded holes 35 for securing the cover 21 to the base 31. A right angle preferred embodiment 37 located at the backend of the embodiment 31 wherein a half circle is formed to partially enclose a portion of the electrical cable and guide it substantially at a right angle. The right angle embodiment 37 is chamfered on both sides of its back corners 43 to create a low profile embodiment. FIG. 3 further illustrates retaining notches 38 on both sides of the chamber walls to maintain fixed position and stability for the terminal connector within the chamber 41.

Figure 3A:
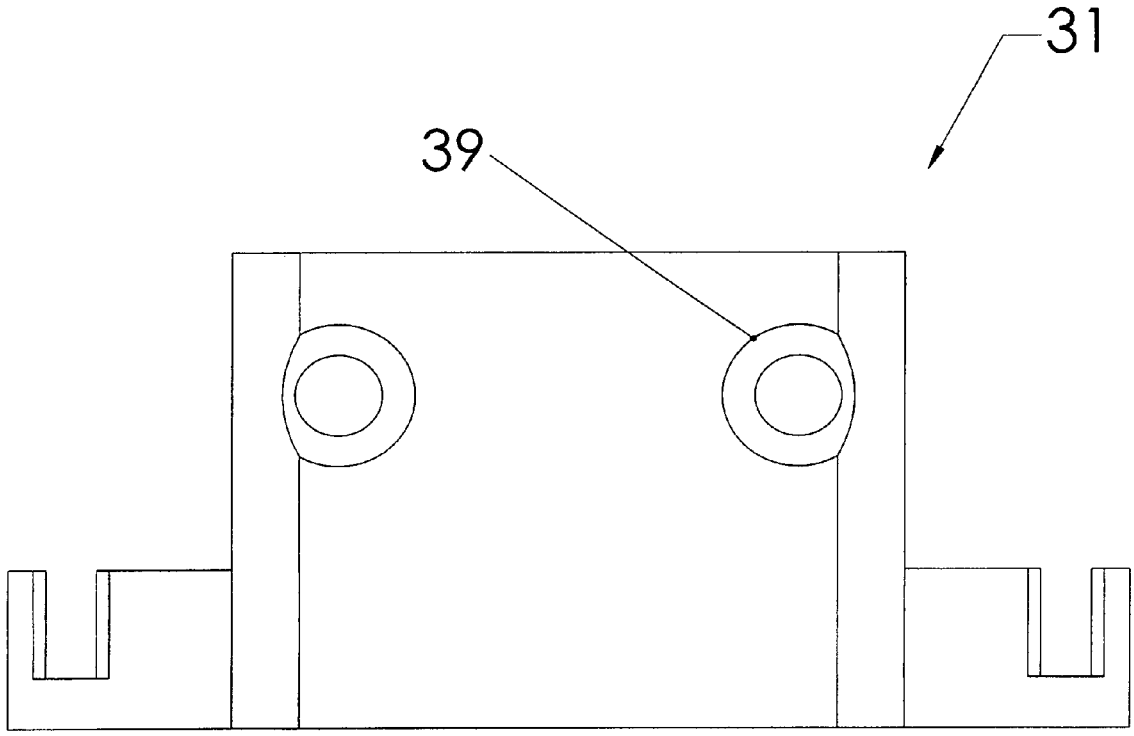
FIG. 3A is a back view of the base in conformance with the present invention.

FIG. 3A illustrate the back view of embodiment 31 wherein includes a left and right thru holes and countersink 39 to pull the cover 21 around the cable and secure the base 31 to the cover 21 by means of countersink screws.

While the above is a complete description of specific embodiments of the present invention, various modifications, variations, and alternatives maybe employed. For example, the preferred embodiments 37 and 25 could be modified in various angles other than just 90 degrees it could be any angle to accommodate the space and the mating device. For example, 30, 45, 60 degrees or whatever angle to meet the required applications. Additionally, openings 51 and 52 for admitting cable could be modified in different geometry such as oval, elliptical or others. Further, the retaining notches 38 could be modified to a wider width to accommodate different versions of connectors. The backshell assembly 50 could be made from different material such as aluminum, steel, brass or family of plastics. Furthermore, The backshell assembly could be manufactured in different sizes. The backshell assembly could be manufactured by means of machining from blank material, casting or stamping or different methods. The backshell could have different finish like plating, powder coating, painting and different methods coating.

While the invention is shown in only one of its forms, it is not thus limited but is susceptible to various changes and modifications without departing from the spirit and scope of the invention.

What is claimed is:

1. A low profile angular backshell assembly for an electrical cable connector assembly, the backshell comprising:

a base and a cover, an interior longitudinal chamber through the backshell, the interior longitudinal chamber having a first opening at a substantially right angle perpendicular to a main plane of the chamber, the first opening receiving a section of a cable and a second opening through the backshell fitting around a terminal connector and to cooperate with exterior features of a respective mating device;

wherein a substantially right angle turn in a cable section perpendicular to the plane of chamber of the backshell enables the assembly to be connected to the respective mating device in a limited clearance space; the cover is attached to the base by two screws from the top of the cover to the base and by interengaging features along sides of the cover and the base and by engaging and securing two screws to the rear of the cover and base, the screws passing through openings adjacent a cable gripping section of the base and cover to secure the cover to the base and wherein the connector backshell assembly is attached to the mating device by means of jack screws.

2. A backshell as claimed in claim 1 further comprising: a first half shell base having an interior surface defining a longitudinal section of the interior chamber and further defined by an edge which, in part, forms a portion of the first opening for the cable section which is perpendicular to the plane of chamber of the backshell and a portion of the second opening fitting around at least a portion of the exterior features of the terminal connector, and a second half shell cover having an interior surface defining a longitudinal section of the interior chamber and further defined by an edge which, in part, forms a portion of the first opening of the cable section which is perpendicular to the plane of chamber of the backshell and a portion of the second opening.

3. A method of assembly a backshell for an electrical cable assembly comprising:

a base and a cover; an interior longitudinal chamber through the backshell, the interior longitudinal chamber having a first opening at a substantially right angle perpendicular to a main plane of the chamber, the first opening receiving a section of a cable and a second opening through the backshell fitting around a terminal connector and to cooperate with exterior features of a respective mating device;

placing jackscrews through channels formed between the chamber and side walls of the base;

mounting the cable connector assembly in the interior chamber and forcing the cable in a right angle turn which is perpendicular to the main plane of the chamber of the backshell;

attaching the cover to the base by causing interengaging features along the sides of the cover and the base to engage and securing two screws to the rear of the cover and base, the screws passing through openings adjacent a cable gripping section of the base and cover to secure the cover to the base; securing other two top screws and tighten screws, attaching the backshell to the mating device by means of the jackscrews.

* * * * *